US007544647B1

(12) United States Patent
Narula et al.

(10) Patent No.: US 7,544,647 B1
(45) Date of Patent: Jun. 9, 2009

(54) ALDEHYDES AND DERIVATIVES FOR FRAGRANCE USE

(75) Inventors: Anubhav P. S. Narula, Hazlet, NJ (US); Edward Mark Arruda, Easton, PA (US)

(73) Assignee: International Flavors & Fragrances Inc., New York, NY (US)

( * ) Notice: Subject to any disclaimer, the term of this patent is extended or adjusted under 35 U.S.C. 154(b) by 0 days.

(21) Appl. No.: 12/037,657

(22) Filed: Feb. 26, 2008

(51) Int. Cl.
*C11D 3/50* (2006.01)

(52) U.S. Cl. ..... 510/107; 512/26; 560/1

(58) Field of Classification Search ..... 510/107; 512/26; 560/1
See application file for complete search history.

(56) References Cited

U.S. PATENT DOCUMENTS 2,806,882 A * 9/1957 Surmatis et al. ..... 568/417
3,694,526 A * 9/1972 Siddall et al. ..... 558/217

FOREIGN PATENT DOCUMENTS

CA 941383 * 2/1974

* cited by examiner

*Primary Examiner*—John R Hardee
(74) *Attorney, Agent, or Firm*—Elizabeth M. Quirk; XuFan Tseng; Joseph F. Leightner

(57) ABSTRACT

The present invention is directed to compounds and their use in fragrance and flavor applications, represented by the general formula set forth below:

Formula I

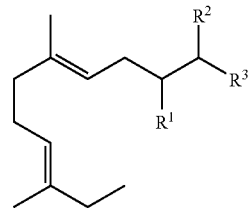

wherein $R^1$ can be selected from H or

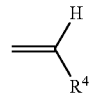

wherein $R^4$ is independently selected from H, $CH_3$, and $CH_2CH_3$;
$R^2$ and $R^3$ can be independently selected from H, =O, $CH_3$, $OCH_3$, CH=O and —OAc.

8 Claims, No Drawings

ALDEHYDES AND DERIVATIVES FOR FRAGRANCE USE

FIELD OF THE INVENTION

The present invention relates to new chemical entities and the incorporation and use of the new chemical entities as fragrance materials.

BACKGROUND OF THE INVENTION

There is an ongoing need in the fragrance industry to provide new chemicals to give perfumers and other person ability to create new fragrances for perfumes, colognes and personal care products. Those with skill in the art appreciate how differences in the chemical structure of a molecule can result in significant differences in the odor, notes, and characteristics of the molecule. These variations and the ongoing need to develop new fragrances allow perfumers and other persons to apply new chemicals in creating new fragrances.

SUMMARY OF THE INVENTION

The present invention provides novel chemicals, and the use of the chemicals to enhance the fragrance of perfumes, toilet waters, colognes, personal products and the like. In addition, the present invention is directed to the use of the novel chemicals to enhance fragrance in perfumes, toilet waters, colognes, personal products and the like.

More specifically, the present invention is directed to compounds, represented by the general formula set forth below:

Formula I

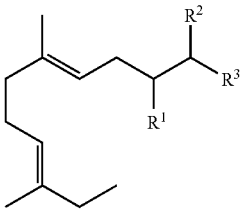

Wherein $R^1$ can be selected from H or

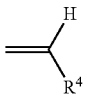

wherein $R^4$ is independently selected from H, $CH_3$, and $CH_2CH_3$;

$R^2$ and $R^3$ can be independently selected from H, =O, $CH_3$, $OCH_3$, CH=O and —OAc.

In another embodiment of the invention, the following compound is provided:

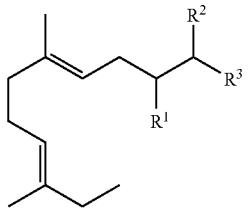

wherein $R^1$ is H;

$R^2$ is —OAc; and $R^3$ is equal to H.

In yet another embodiment of the invention, the following compound is provided:

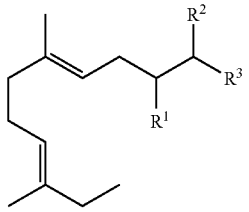

wherein $R^1$ is equal to H; $R^2$ is equal to $CH_3$; and $R^3$ is equal to CH=O.

In another embodiment of the invention, the following compound is provided:

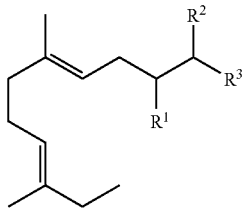

wherein $R^1$ and $R^3$ is independently equal to H; and $R^2$ is =O.

In yet another embodiment of the invention, the following compound is provided:

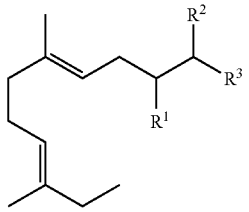

wherein $R^1$ is equal to

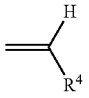

wherein $R^4$ is H;

$R^2$ is equal to =O; and $R^3$ is equal to H.

In another embodiment of the invention, the following compound is provided:

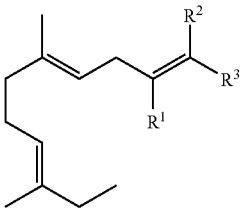

wherein $R^1$ is equal to H;

$R^2$ is equal to H; and $R^3$ is equal to $OCH_3$.

It is understood by one skilled in the art that "Ac" stands for an acetyl group (—COCH3).

Another embodiment of the invention is directed to a method for enhancing a perfume composition by incorporating an olfactory acceptable amount of the compounds provided above.

In yet another embodiment of the invention is directed to fragrance formulations containing the compounds provided above.

These and other embodiments of the present invention will be apparent by reading the following specification.

DETAILED DESCRIPTION OF THE INVENTION

In a preferred embodiment of the invention, the novel compounds of the present invention are represented by the following structures:

Structure I

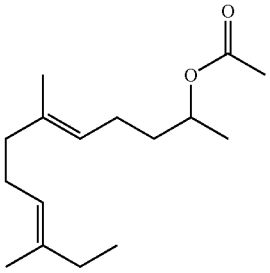

-continued

Structure II

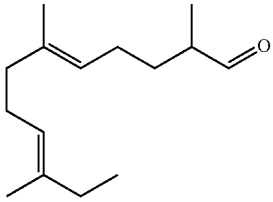

Structure III

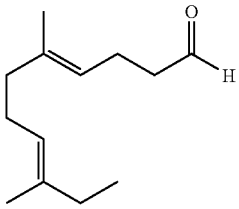

Structure IV

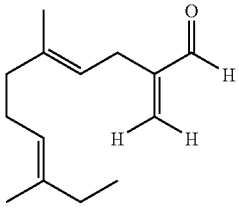

Structure V

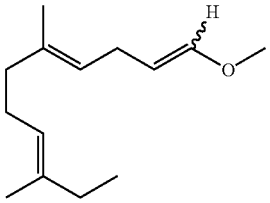

Those with the skill in the art will appreciate that the following compounds:

Structure I is 5,9-Dodecadien-2-ol, 6,10-Dimethyl-, Acetate (5E,9E)

Structure II is 5,9-Dodecadienal, 2,6,10-Trimethyl-, (5E, 9E);

Structure III is 4,8-Undecadienal, 5,9-Dimethyl;

Structure IV is 4,8-Undecadienal, 5,9-Dimethyl-2-Methylene-, (4E,8E)-;

Structure V is 1,4,8-Undecatriene, 1-methoxy-5,9-Dimethyl (1E and Z,4E, 8E).

The compounds of the present invention may be prepared by subjecting the starting materials of ethyl linalool and butyl vinyl ether to Mannich reaction with an aqueous solution of formaldehyde.

Preparation of Structure I 5,9-Dodecadien-2-ol, 6,10-Dimethyl-, Acetate (5E,9E)

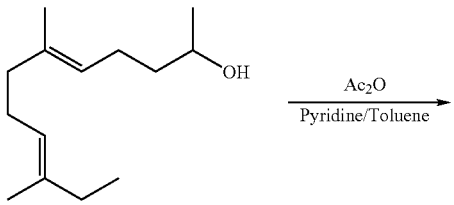

Material A

-continued

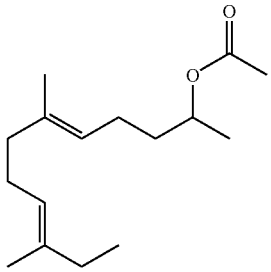

Structure I

Material A is known by one skilled in the art as 5,9-Dodecadiene-2-ol, 2,6,10-trimethyl)

Preparation of Structure II 5,9-Dodecadienal, 2,6,10-Trimethyl-, (5E,9E);

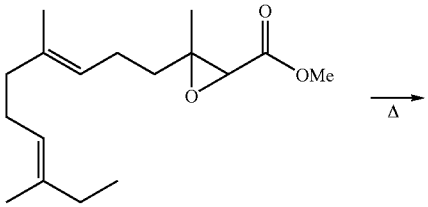

Material B

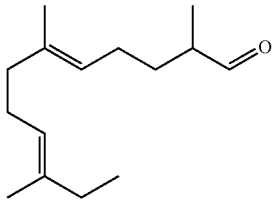

Structure II

Material B is known by one skilled in the art as [2-oxirane carboxylic acid, 3-methyl-3-(4,8-dimethyl-3,7-decadienyl), methyl ester]

Preparation of Structure III 4,8-Undecadienal, 5,9-Dimethyl

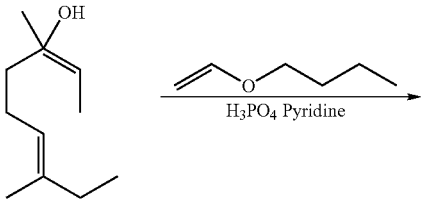

Material C

-continued

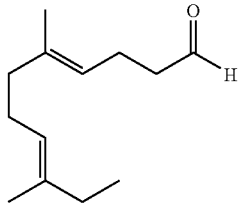

Structure III

Material C is known by one skilled in the art as ethyl linalool

Preparation of Structure IV, 4,8-Undecadienal, 5,9-Dimethyl-2-Methylene-, (4E,8E)-,

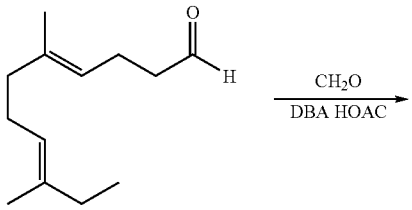

Structure III

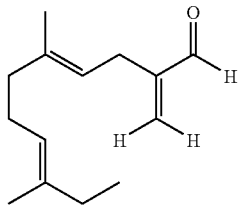

Structure IV

Preparation of Structure V, 1,4,8-Undecatriene, 1-methoxy-5,9-Dimethyl (1E and Z,4E,8E)

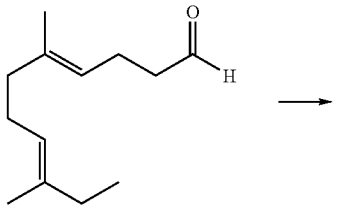

Structure III

-continued

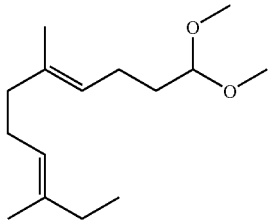

Material D

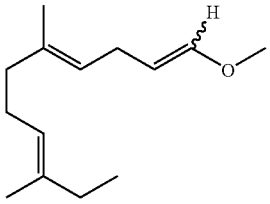

Structure V

Material D is known by one skilled in the art as [1,4,8-undecatriene, 1-methoxy-5,9-dimethyl].

We have discovered that the compounds of the present invention have a fresh citrus odor and that Structure III possesses fresh citrus, ozone and aldehydic character that are well suited for use as a fragrance ingredient.

The use of the compounds of the present invention is widely applicable in current perfumery products, including the preparation of perfumes and colognes, the perfuming of personal care products such as soaps, shower gels, and hair care products as well as air fresheners and cosmetic preparations. The present invention can also be used to perfume cleaning agents, such as, but not limited to detergents, dishwashing materials, scrubbing compositions, window cleaners, fabric care products such as but not limited to fabric softeners, dryer sheets and the like.

In these preparations, the compounds of the present invention can be used alone or in combination with other perfuming compositions, solvents, adjuvants and the like. Those with skill in the art will appreciate the nature and variety of the other ingredients that can be used in combination with the compound of the present invention.

Many types of fragrances can be employed in the present invention, the only limitation being the compatibility with the other components being employed. Suitable fragrances include but are not limited to fruits such as almond, apple, cherry, grape, pear, pineapple, orange, strawberry, raspberry; musk, flower scents such as lavender-like, rose-like, iris-like, carnation-like. Other pleasant scents include herbal and woodland scents derived from pine, spruce and other forest smells. Fragrances may also be derived from various oils, such as essential oils, or from plant materials such as peppermint, spearmint and the like.

A list of suitable fragrances is provided in U.S. Pat. No. 4,534,891, the contents of which are incorporated by reference as if set forth in its entirety. Another source of suitable fragrances is found in *Perfumes, Cosmetics and Soaps*, Second Edition, edited by W. A. Poucher, 1959. Among the fragrances provided in this treatise are acacia, cassie, chypre, cyclamen, fern, gardenia, hawthorn, heliotrope, honeysuckle, hyacinth, jasmine, lilac, lily, magnolia, mimosa, narcissus, freshly-cut hay, orange blossom, orchid, reseda, sweet pea, trefle, tuberose, vanilla, violet, wallflower, and the like.

As used herein olfactory effective amount is understood to mean the amount of compound in perfume compositions the individual component will contribute to its particular olfactory characteristics, but the olfactory effect of the perfume composition will be the sum of the effects of each of the perfumes or fragrance ingredients. Thus the compounds of the invention can be used to alter the aroma characteristics of the perfume composition, or by modifying the olfactory reaction contributed by another ingredient in the composition. The amount will vary depending on many factors including other ingredients, their relative amounts and the effect that is desired.

The level of compound of the invention employed in the perfumed article varies from about 0.005 to about 10 weight percent, preferably from about 0.1 to about 8, and more preferably from about 0.5 to about 5 weight percent. In addition to the compounds other agents can be used in conjunction with the fragrance. Well known materials such as surfactants, emulsifiers, polymers to encapsulate the fragrance can also be employed without departing from the scope of the present invention.

Another method of reporting the level of the compounds of the invention in the perfumed composition, i.e., the compounds, as parts per million (ppm) of the materials added to impart the desired fragrance. The compounds of the invention can range widely from 0.005 to about 10 ppm of the perfumed composition, and preferably from about 0.1 to about 5 ppm. Those with skill in the art will be able to employ the desired level of the compounds of the invention to provide the desired fragrance and intensity.

All U.S. patents and patent applications cited herein are incorporated by reference as if set forth herein in their entirety.

The following are provided as specific embodiments of the present invention. Other modifications of this invention will be readily apparent to those skilled in the art. Such modifications are understood to be within the scope of this invention. All starting materials, reagents and catalysts were purchased from Aldrich Chemical Company and used as is. As used herein all percentages are weight percent unless otherwise noted, ppm is understood to stand for parts per million, L is understood to be liter, mL is understood to be milliliter, Kg is understood to be kilogram, g is understood to be gram, and mmHg be millimeters (mm) of mercury (Hg). IFF as used in the examples is understood to mean International Flavors & Fragrances Inc., New York, N.Y., USA.

EXAMPLE I

Preparation of 5,9-Dodecadien-2-ol, 6,10-Dimethyl-,Acetate (5E,9E)

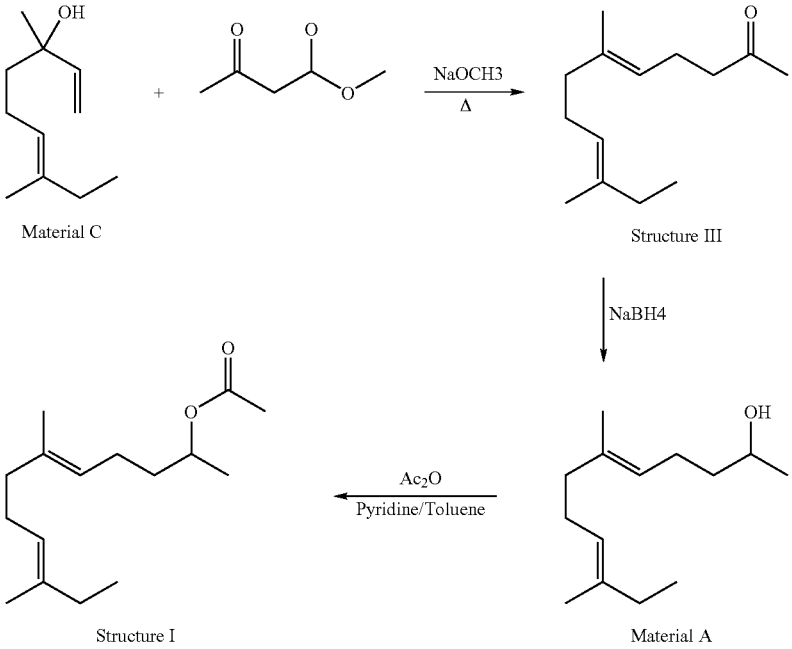

Structure I was prepared according to the following process. First, Material A, 6,10-dimethyl-dodeca-5,9-dien-2-ol, was prepared by Carroll rearrangement of Material C, ethyl linalool, with methyl acetoacetate using sodium methoxide to provide Structure III and then followed by reduction with sodium borohydride.

Structure I was prepared as follows, 300 ml of toluene, 5.6 g of pyridine and 300 ml of alcohol were charged together and heated to 70° C. Acetic anhydride was added drop wise over 2 hours, sampled again and aged for 2-3 hours and then sampled again and cooled to below 70° C. 100 ml of water was added and heated to 80° C. for 30 minutes. The sample was cooled and washed two times with 1 liter of cold water and neutralize with 1 liter of 10% $NaCO_3$ solution and set up for rushover and fractionation.

The NMR spectrum of the 5,9-Dodecadien-2-ol, 6,10-Dimethyl-,Acetate (5E,9E) is as follows: 1.0 ppm (s, 3H), 1.2 ppm (s, 3H), 1.6 ppm (d, 3H), 2.0 ppm (s, 3H), 1.8502.1 ppm (m, 11H), 4.9 ppm (m, 1H), 5.1 ppm (m, 2H).

EXAMPLE II

Preparation of 5,9-Dodecadienal, 2,6,10-Trimethyl-, (5E,9E)

Structure TI, 5,9-Dodecadienal, 2,6,10-Trimethyl-, (5E, 9E) was prepared by the following process detailed in the reaction scheme below:

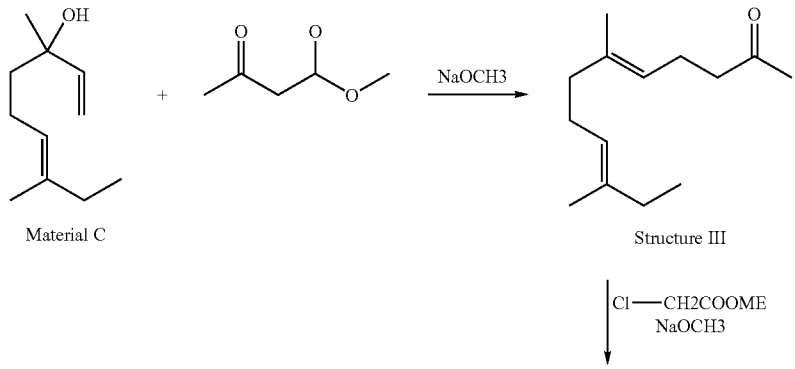

-continued

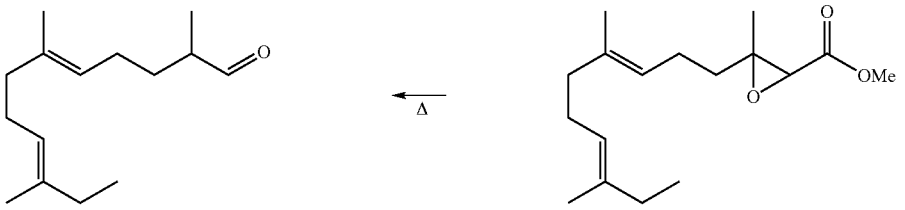

Structure II Material B 43 g of sodium hydroxide and 700 ml of methanol were charged in a pot and then stirred until dissolved and cooled to 0° C. Then 290 g of ester was added dropwise over 2 hours and the sample was aged at room temperature. 500 ml of water and 500 ml of toluene were added to sample and then sample was allowed to settle and separate and the top layer retained. The lower layer was added to reaction pot and phosphoric acid was added slowly, and then allowed to settle and the top layer was separated and the top layer was bottled up for next step. 10 grams of primol was added to the pot and heated to 220° C. Acid was added with an addition funnel slowly and then the product was distilled. The fraction was washed with 5% $NaHCO_3$ solution.

The NMR spectrum of the 5,9-Dodecadienal, 2,6,10-Trimethyl-, (5E,9E) is as follows: 0.9-1.08 ppm (m, 9H), 1.2-1.8 ppm (m, 9H), 1.75 ppm (s, 3H), 1.9-2.4 ppm (m, 13H), 5.1 ppm (m, 2H), 9.6 ppm (d, 1H).

EXAMPLE III

Preparation of 4,8-Undecadienal,5,9-Dimethyl

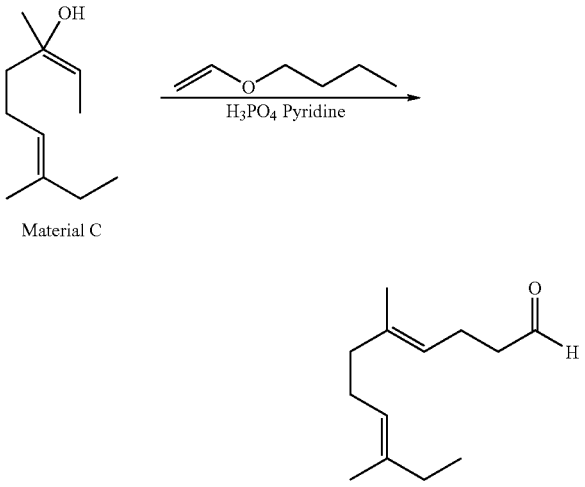

Material C Structure III

All the reagents, Butyl vinyl ether (Aldrich Chemical Company), phosphoric acid and pyridine were charged to a pot and heated to 90° C. and then up to 103° C. to reflux using a distillation unit with 10% take off and collected. [50 ml of butanol collected]. The heating was continued to a temperature of 150° C. until the vapor temperature came down to 50° C. and then cooled to 31° C. and quenched with saturated sodium bicarbonate solution [100×2] to a pH of 9.

The NMR spectrum of the 4,8-Undecadienal, 5,9-Dimethyl is as follows: 1.0 ppm (t, 3H), 1.55 ppm (s, 3H), 1.65 ppm (s, 3H), 1.7-2.35 ppm (m, 11H), 2.4 ppm (d, 2H), 5.1 ppm (m, 2H), 9.7 ppm (d, 1H).

Structure III possesses fresh citrus, ozone and aldehydic character that are well suited for use as a fragrance ingredient.

EXAMPLE IV

Preparation of 4,8-Undecadienal,5,9-Dimethyl-2-Methylene-,(4E,8E)-

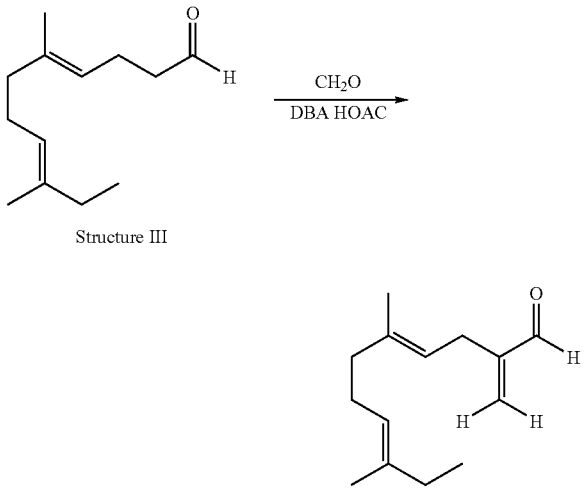

Structure III Structure IV 7.2 g of acetic acid, 7.7 g of dibutyl amine and 90 g of formaldehyde were charged to a pot and stirred and heated to 70° C. 198 g of aldehyde was added drop wise over 1 hour, at the end of addition the pot was sampled and then at maximum conversion, cooled and quenched with 500 ml of cold water and 250 ml of toluene and then allowed to sit, settle and concentrated and rushed over.

The NMR spectrum of the 4,8-Undecadienal,5,9-Dimethyl-2-Methylene-,(4E,8E) is as follows: 0.95 ppm (s, 3H), 1.5 ppm (s, 3H), 1.6 ppm (s, 3H), 1.65-2.2 ppm (m, 9H), 2.95 ppm (s, 2H), 5.05 ppm (m, 1H), 5.18 ppm (m, 1H), 6.1 ppm (d, 2H), 9.6 ppm (s, 1H).

EXAMPLE V

Preparation of 1,4,8-Undecatriene, 1-methoxy-5,9-Dimethyl (1E and Z,4E,8E)

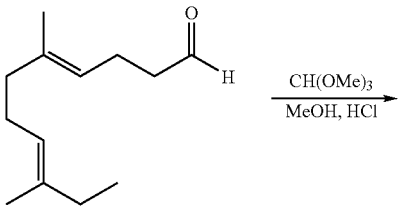

Structure III

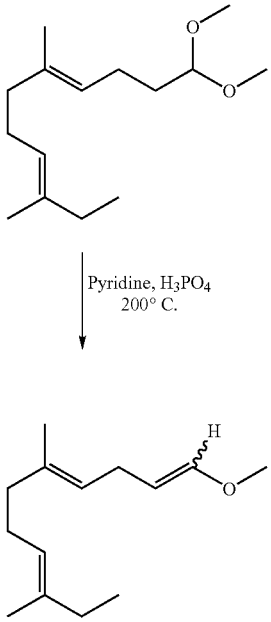

Structure V 26 g of 5,9-dimethyl-4,8-undecadienal dimethylacetal (prepared from 5,9-dimethyl-4,8-undecadienal and trimethyl orthoformate were charged in methanol and using a catalytic amount of HCL) followed by 1 g of pyridine, 0.5 g of phosphoric acid and stir and heat to 200° C. The methanol formed was collected (0.5 g). The reaction was cooled and quenched with 3 g of 25% sodium methoxide solution in methanol followed by rushover distillation.

The NMR spectrum of 1,4,8-Undecatriene, 1-methoxy-5,9-Dimethyl is as follows: 1.0 ppm (t, 3H), 1.55 ppm (s, 3H), 2.75 ppm (s, 3H), 1.9-2.1 ppm (m, 6H), 2.6-2.8 ppm (m, 2H), 3.5-3.6 ppm (2s, 3H), 4.35-4.7 ppm (2m, 1H), 5.1 ppm (m, 2H), 5.9-6.3 ppm (2s, 1H). NMR revealed it to be is a mixture of cis-enol ether (64%) and trans-enol ether (36%).

EXAMPLE VI

Incorporation of 4,8-Undecadienal, 5,9-Dimethyl into a Fragrance Formulation

| | Parts |
|---|---|
| Allyl Cyclohexyl Propionate | 5.00 |
| Amyl Salicylate | 39.00 |
| Benz Acetate | 5.00 |
| Benz Benzoate | 8.00 |
| Bergamot Oil | 30.00 |
| Citronellol Extra | 80.00 |
| Citronellyl Acetate | 34.00 |
| Dihydro Myrcenol | 30.00 |
| Eugenol Trubek | 1.00 |
| Hedione BHT | 83.00 |
| Cis-3-Hexenyl Salicylate | 3.00 |
| Indole | 1.00 |
| Lilial | 66.00 |
| Linalool | 160.00 |
| Linalyl Acetate | 60.00 |
| Phenyl Ethyl Alcohol White Extra | 90.00 |
| 4,8-Undecadienal, 5,9-Dimethyl | 2.50 |
| | 695.00 |

The addition of 4,8-Undecadienal, 5,9-Dimethyl adds a natural, floral twist to the fragrance and makes it more diffusive.

What is claimed is:

1. A compound

Formula I

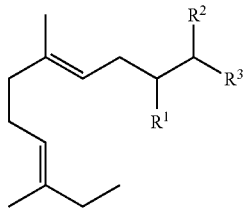

wherein $R^1$ and $R^3$ is independently equal to H; and $R^2$ is —OAc.

2. A method of improving, enhancing, or modifying a fragrance formulation through the addition of an olfactory acceptable amount of a compound

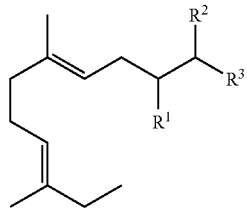

wherein $R^1$ and $R^3$ is independently equal to H; and $R^2$ is —OAc.

3. The method of claim 2 wherein the fragrance is incorporated into a product selected from a perfume, a cologne, a toilet water, a cosmetic product, a personal care product, a fabric care product, a cleaning product, and an air freshener.

4. The method of claim 3 wherein the cleaning product is selected from the group consisting of a detergent, a dishwashing composition, a scrubbing compound, and a window cleaner.

5. The method of claim 2, wherein the amount of the compound added into the fragrance formulation is from about 0.005 to about 10 weight percent.

6. The method of claim 2, wherein the amount of the compound added into the fragrance formulation is from about 0.1 to about 8 weight percent.

7. The method of claim 2, wherein the amount of the compound added into the fragrance formulation is from about 0.5 to about 5 weight percent.

8. A fragrance formulation containing an olfactory effective amount of a compound

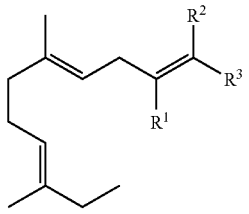

wherein $R^1$ and $R^3$ is independently equal to H; and $R^2$ is —OAc.

* * * * *